US005213032A

United States Patent [19]

van Akkeren et al.

[11] Patent Number: 5,213,032

[45] Date of Patent: May 25, 1993

[54] STENCIL DRIVE FOR A SCREEN PRINTING MACHINE

[75] Inventors: Franciscus J. J. van Akkeren, Stramproy; Jan H. Nekkers, Gennep; Robert J. van den Berg, Ewijk; Humphry G. E. Beck, Eindhoven; Carolus T. J. A. van Sas, Helmond, all of Netherlands

[73] Assignee: Stork Brabant B.V., Boxmeer, Netherlands

[21] Appl. No.: 908,162

[22] Filed: Jul. 2, 1992

[30] Foreign Application Priority Data

Jul. 4, 1991 [NL] Netherlands ..... 9101165

[51] Int. Cl.[5] ..... B41L 13/04

[52] U.S. Cl. ..... 101/116; 101/119; 101/129

[58] Field of Search ..... 101/116, 117, 118, 119, 101/120, 129, 216

[56] References Cited

U.S. PATENT DOCUMENTS

| | | | |
|---|---|---|---|
| 3,718,086 | 2/1973 | Vertegaal | 101/116 |
| 3,811,378 | 5/1974 | Bohm | 101/120 |
| 3,914,629 | 10/1975 | Gardiner | 310/46 |
| 4,384,521 | 5/1983 | Muselaers | 101/116 |

FOREIGN PATENT DOCUMENTS

| | | |
|---|---|---|
| 0244034 | 11/1987 | European Pat. Off. . |
| 0396924 | 11/1990 | European Pat. Off. . |

*Primary Examiner*—Edgar S. Burr
*Assistant Examiner*—Ren Yan
*Attorney, Agent, or Firm*—Bell, Seltzer, Park & Gibson

[57] ABSTRACT

A screen printing machine comprises a frame in which one or more stencils are supported for printing a web of material fixed on a supporting belt. The stencils are each directly connected by means of a rigid coupling to the rotor of a corresponding rotary drive device. An elongated squeegee, supported near the ends of the stencil, is provided in the interior of each stencil. The drive device is provided with a central through hole running in the axial direction, for allowing through at least the end of the squeegee with radial play.

9 Claims, 2 Drawing Sheets

STENCIL DRIVE FOR A SCREEN PRINTING MACHINE

BACKGROUND OF THE INVENTION

This invention relates to a screen printing machine, comprising a frame in which one or more rotary, cylinder-surface-shaped stencils are supported for printing a web of material fixed on a supporting belt, which stencils are detachably connected to corresponding rotary drive devices with a stationary stator securely fixed to the frame, and a rotor which is connected to the corresponding stencil and rotates relative to the stator, while an elongated squeegee, supported near the ends of the stencil, is provided in the interior of each stencil.

DISCUSSION OF THE PRIOR ART

A screen printing machine as described above, for example used for printing textiles in several colours, is known from European Patent Application 0,396,924. This application describes how the stencils are connected by mechanical transmissions to respective corresponding stepping motors, which are fed with pulses in such a way that the peripheral speed of the different stencils is the same and is in a predetermined relation to the speed of the web of material to be printed. In the known screen printing machine this relation is determined by detecting the speed of the supporting belt of the web of material and converting this information into a pulse train suitable for controlling each stepping motor separately, bearing in mind the necessary registering of the stencils. This registering takes place by electronic means.

For the electrical engineering expert it will be clear that there are many other solutions for achieving a suitable control of an electrical machine which is connected to a stencil for driving it. If, for example, the electrical machines used are synchronous machines or direct current machines, in order to achieve an accurate control of the machines, it is necessary to fit rotor angle position sensors or rotor angle speed sensors and to feed back the readings of these to a comparator for comparison to the speed of the web of material.

Apart from that, the use of an electrical drive device is not absolutely necessary, and pneumatic or hydraulic drive devices are also conceivable, provided that they at least meet specific requirements as regards load carrying capacity, accuracy, speed, controllability etc.

For the printing of a web of material, the stencils have paste or dye applied from a supply line to their inner periphery, in an elongated region extending in the axial direction between the two ends of the stencil, said paste or dye being applied with a squeegee and pressed through minute holes in the stencil. For an independent position setting of the squeegee relative to the inner surface of the stencil, the squeegee is supported outside the stencil at both its ends in an adjustable support construction which permits an axial, radial and tangential adjustment of each squeegee end support.

It was usual until now to make the drive device of a stencil such that the axes of the stencil and the driving machine were not in line with each other, in order to permit the arrangement of the assembly of stencil and squeegee described above. Thus a mechanical transmission was always necessary between stencil and drive device, since the squeegee support construction at one end of the stencil rules out the use of a direct coupling between the rotor shaft of a conventional drive machine and a stencil at this point.

Although the use of individual electronically synchronised drive devices for each stencil has already eliminated some of the printing pattern inaccuracies found in the conventional screen printing machines, which for several stencils only have one drive device and a system of a mechanical distritubor device and transmissions, with a considerable cumulative play and shape or manufacturing deviations, the play present in the mechanical transmission according to the prior art between an individual drive device and its corresponding stencil still leads to undesirable shifts between patterns produced by different stencils on the web of material to be printed. This play also adversely influences the control performance of the drive devices.

Since in the interaction between a driven moving web of material and a driven rotary stencil being in contact therewith, viewed from this stencil at various times, energy can be both supplied to and withdrawn from the material, the abovementioned play is an uncontrollable factor in screen printing which does not give the best quality of result.

SUMMARY OF THE INVENTION

The object of the invention is to provide a screen printing machine in which there is no play between a stencil and the corresponding drive device, through the absence of a mechanical transmission between them, and in which nonetheless sufficient space is left for a support construction for the ends of a squeegee and for easy insertion and removal of the squeegee.

This object is attained according to the invention in a screen printing machine wherein the rotor of each drive device can be directly connected by means of a rigid coupling to one end of the corresponding stencil, the drive device being provided with a central through hole running in the axial direction, for allowing through at least the end of the squeegee with radial play. The axes of rotation of the drive device and the corresponding stencil generally coincide in the screen printing machine according to the invention. The screen printing machine can have two drive devices per stencil, i.e. one for each end of a stencil.

Preferred embodiments of the screen printing machine according to the invention are described in the sub-claims.

The claims and advantages will be more readily appreciated as the same becomes better understood by reference to the following detailed description and considered in connection with the accompanying drawings, which show two different preferred embodiments in partial longitudinal section of one stencil end which is rigidly connected to an electrical drive device. In the drawings like reference symbols designate like parts.

DESCRIPTION OF THE PREFERRED EMBODIMENTS

Figure 1:
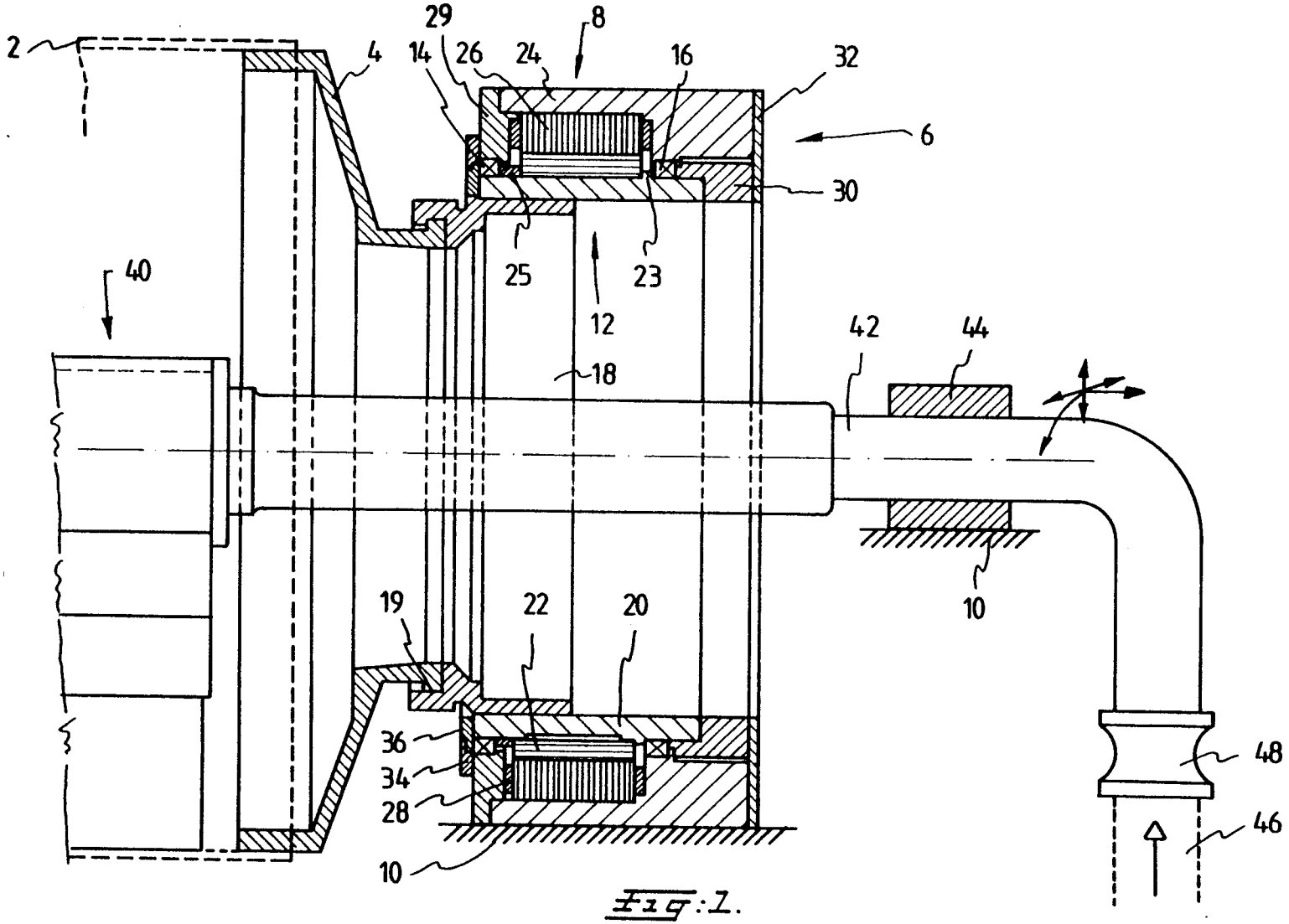
FIG. 1 shows an electrical machine with an external stator and an internal rotor.

FIG. 1 shows a part of a stencil 2, i.e. a perforated, cylinder-surface-shaped plate for printing a web of fabric or the like. The stencil 2 is provided with a carrier 4, by means of which the stencil 2 can be rigidly connected to a drive device, which is indicated in general by 6. The drive device 6 is used for rotary driving the stencil 2 and in the embodiment shown is an electrical type, but it can also be hydraulic or pneumatic. The drive device 6 comprises a stator 8 which is securely fixed to a frame 10 of a screen printing machine, and a rotor 12 which is supported by means of suitable bearings 14 and 16 so that it rotates in the stator 8. An essentially annular coupling flange 18 is fixed to the rotor 12 by moulding-in, glueing, screw connections or the like. The coupling flange 18 is rigidly and detachably coupled to the carrier 4 of the stencil 2 by means of a bayonet coupling 19.

The rotor 12 of the electromechanical drive device 6 comprises an essentially cylinder-surface-shaped yoke 20, along the outer periphery of which a number of alternately poled permanent magnets 22 are fitted, these magnets being fixed in the axial direction between a rib 23 along the outer periphery of the yoke 20 and a clamping ring 25. The stator 8 comprises an essentially cylinder-surface-shaped stator yoke 8 which has along a part of the inner periphery thereof a set of laminations 26 with grooves for windings 28. The set of laminations 26 and the windings 28 are fixed axially in the stator yoke 8 by a flange 29. The drive device 6 also has a rotor angle position sensor 30 which is known in many different forms, and is therefore not shown in any further detail. Such a rotor angle position sensor comprises a part (not shown) fixed to the stator and a part (not shown) fixed directly to the rotor. Its operation can be based on, for example, optical or magnetic principles, so that a bivalent or polyvalent signal is produced which forms an accurate indication of the absolute or relative position of the rotor 12 relative to the stator 8 of the electrical drive device 6.

Suitable seals 32, 34 and 36 are fitted at the two end faces of the electrical drive device 6, the first two being connected to the stator 8, while the last one is connected to the rotor 12, as a result of which the penetration of dust, dirt and the like into the interior of the electrical drive device 6 is prevented.

The arrangement of the drive device 6 described makes it possible to support a squeegee 40 entirely independently of it at its ends, and to place it in position in the interior of the stencil 2 relative to the internal surface of said stencil. The drive device 6 also has a large enough opening for removing and inserting the squeegee 40. The end 42 of the squeegee 40 is clamped in a schematically shown support construction 44 which is connected to the frame 10 of the screen printing machine, and by means of which an independent axial, radial and tangential positioning of the local squeegee support is possible, as is shown symbolically by the six-point combination of arrows.

The squeegee end 42 comprises a channel for the supply of paste or dye to the squeegee 40 from a supply line 46 which is connected by means of a coupling piece 48 to the squeegee end 42.

Figure 2:
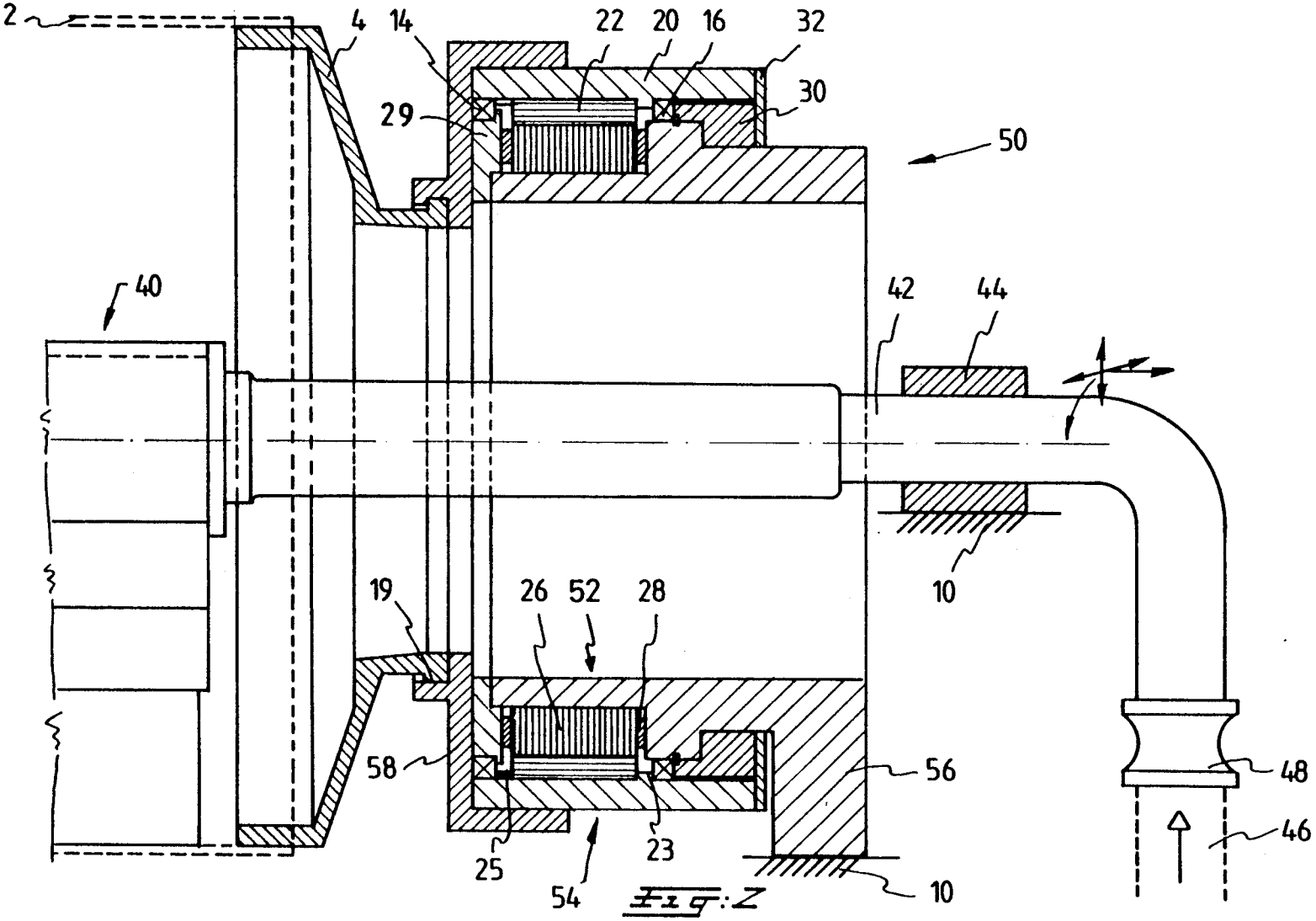
FIG. 2 shows an electrical machine with an internal stator and an external rotor.

The device shown in FIG. 2 comprises essentially the same elements with the same functions as the device shown in FIG. 1, but a fundamental difference between the embodiments shown in FIG. 1 and those shown in FIG. 2 is the design of the electrical drive device 50, the stator 52 of which is situated largely inside the rotor 54 in FIG. 2. Such an arrangement has consequences for the connection of the stator 52 to the frame 10, which connection in FIG. 2 is produced by a flange part 56, and for the design of the coupling flange 58 between the rotor 54 and the carrier 4 of the stencil 2. The coupling flange 58 in FIG. 2 is fixed to the outer periphery of the rotor 54 by means of shrinking, glueing, screw connections or the like.

The electrical drive device shown in FIGS. 1 and 2 can also be designed like any other type of electrical drive device such as a direct current machine, possibly with a permanently magnetic stator, or a stepping motor, this depending on the desired characteristics of the control of the drive device. It is also possible to provide the two ends of a stencil each with a drive device.

While the invention has been described and illustrated in its preferred embodiments, it should be understood that departures may be made therefrom within the scope and spirit of the invention, which is not limited to the details disclosed herein.

What is claimed is:

1. A screen printing apparatus for printing a web of material positioned on a supporting belt, and comprising, a frame, at least one rotary, tubular stencil having a hollow interior for printing the web of material, a rotary drive comprising a stationary stator securely fixed to said frame and a rotor mounted for rotation relative to said stator so as to define a rotational axis, means detachably and rigidly coupling said at least one stencil to said rotor, an elongated squeegee, means mounting said squeegee in the interior of said at least one stencil and including an elongate end which is mounted to said squeegee, and said rotary drive being provided with a central opening which is sufficiently large to permit said elongate end to extend therethrough with radial play.

2. The screen printing apparatus as defined in claim 1 wherein said stator is positioned about the outer periphery of said rotor, and said coupling means comprises a coupling flange secured to said rotor, and a carrier which is secured to said at least one stencil and detachably and directly connected to said coupling flange.

3. The screen printing apparatus as defined in claim 1 wherein said stator is positioned within the inner periphery of said rotor, and said coupling means comprises a coupling flange secured to said rotor, and a carrier which is secured to said at least one stencil and detachably and directly connected to said coupling flange.

4. The screen printing apparatus as defined in claim 1 wherein said rotary drive comprises a synchronous machine.

5. The screen printing apparatus as defined in claim 4 wherein said rotor comprises a plurality of permanent magnets.

6. The screen printing apparatus as defined in claim 1 wherein said rotary drive comprises a direct current machine with an annular collector and radial brushes.

7. The screen printing apparatus as defined in claim 6 wherein said stator comprises a plurality of permanent magnets.

8. The screen printing apparatus as defined in claim 1 wherein said coupling means mounts said tubular stencil so as to be coaxial with said rotational axis.

9. The screen printing apparatus as defined in claim 8 wherein said central opening of said rotary drive is sufficiently large to permit axial removal and insertion of the squeegee therethrough.

* * * * *